US005612162A

United States Patent [19]

Lawson et al.

[11] Patent Number: 5,612,162

[45] Date of Patent: Mar. 18, 1997

[54] LIQUID DEVELOPER FOR ELECTROSTATOGRAPHY

[75] Inventors: Terence M. Lawson, Aldgate; Stephen L. Nicholls, Willunga, both of Australia

[73] Assignee: Research Laboratories of Australia PTY Ltd., Eastwood, Australia

[21] Appl. No.: 500,885

[22] PCT Filed: Jan. 18, 1994

[86] PCT No.: PCT/AU94/00022

§ 371 Date: Jul. 21, 1995

§ 102(e) Date: Jul. 21, 1995

[87] PCT Pub. No.: WO94/17454

PCT Pub. Date: Aug. 4, 1994

[30] Foreign Application Priority Data

Jan. 22, 1993 [AU] Australia ..... PL6905

[51] Int. Cl.[6] ..... G03G 9/125

[52] U.S. Cl. ..... 430/113; 430/137

[58] Field of Search ..... 430/113, 116, 430/137

[56] References Cited

U.S. PATENT DOCUMENTS 5,189,102 2/1993 Tsubuko et al. ..... 525/112

5,384,225 1/1995 Kurotori et al. ..... 430/112

OTHER PUBLICATIONS

Derwent Abstracts of Japan, C-923, p. 131, and Derwent Abstract Accession No. 92-046252/06, Class S06, JP,A, 3-292352 (Ricoh Co Ltd), Dec. 24, 1991—Abstracts.

Derwent Abstract Accession No. 93-080440/10, Class P84, JP,A, 5-25221 (Ricoh KK), Feb. 2, 1993—Abstract.

*Primary Examiner*—John Goodrow

*Attorney, Agent, or Firm*—Evenson, McKeown, Edwards & Lenahan, P.L.L.C.

[57] ABSTRACT

A composition and a method of forming a liquid developer or a constituent of a liquid developer for electrostatography comprising the steps of dispersing at least one monomer in silicone fluid and polymerizing the at least one monomer to form polymer particles in the silicone fluid. A homopolymer or a copolymer may be formed and a colorant, such as a pigment or dye, and a charge control agent may be added before or after the polymerization.

26 Claims, No Drawings

LIQUID DEVELOPER FOR ELECTROSTATOGRAPHY

TECHNICAL FIELD

This invention relates to liquid developers suitable for electrostatography.

BACKGROUND ART

Electrostatography is a term used to describe various non-impact printing processes which involve the creation of a visible image by the attraction of charged imaging particles to charge sites present on a substrate. Such charge sites, forming what is usually termed the "latent image", can be transiently supported on photoconductors or pure dielectrics, and may be rendered visible in situ or be transferred to another substrate to be developed in that location. Additionally, such charge sites may be the reflection of those structured charges existing within a permanently polarised material, as is the case with ferroelectrics and other such electrets.

Electrostatography encompasses those processes normally known as electrophotography and electrography.

In general, a liquid developer for electrostatography is prepared by dispersing an inorganic or organic colorant such as iron oxide, carbon black, nigrosine, phthalocyanine blue, benzidine yellow, quinacridone pink and the like into a liquid vehicle which may contain dissolved or dispersed therein synthetic or naturally occurring polymers such as acrylics, alkyds, rosins, rosin esters, epoxies, polyvinyl acetate, styrene-butadiene etc. Additionally, to effect or enhance the electrostatic charge on such dispersed particles, additives known as charge directors or charge control agents may be included. Such materials can be metallic soaps, fatty acids, lecithin, organic phosphorus compounds, succinimides, sulphosuccinates etc.

In such developers, whether positively or negatively charged, there is one ingredient of common generic character, namely the carrier liquid. Since the beginning of the history of liquid toners, it has been recognised that certain electrical properties of the carrier liquid are mandatory requirements for the effective functioning of a conventional electrostatographic liquid development process. These are low electrical conductivity and other requirements became obvious, such as the needs for low toxicity, increased fire safety, low solvent power, low odour etc. For these reasons, isoparaffinic-hydrocarbons such as the isopar range manufactured by Exxon Corporation, the Shellsol range manufactured by Shell Chemical and the Soltrol range manufactured by Phillips Petroleum became the industry standards for liquid toner carriers.

In more recent times, however, certain deficiencies in these isoparaffins have become apparent. Environmental concerns have placed liquid development processes under increasing pressure to reduce or eliminate volatile emissions. Flammability has also become important regarding the more stringent transport regulations existing and anticipated worldwide.

New designs of image fusing stations are placing increased importance on the thermal stability of carrier liquids.

In order to overcome these limitations other materials applicable to liquid toners have been investigated and of these, silicone fluids are clearly liquids which combine all previously and currently desired properties of a modern liquid toner carrier.

Silicone fluids have been mentioned in the context of liquid toners, e.g. in U.S. Pat. No. 3,105,821 to S. W. Johnson, and in U.S. Pat. No. 3,053,688 to H. G. Greig. Both of these early patents recognised the virtues of silicone fluids, but the understanding of the functioning of liquid toners at that time was relatively empirical, with those patents teaching simply the mechanical dispersion of a dry toner into the silicone fluid with no regard to chemical compatibility, which in turn governs the final particle size and stability of the dispersion so produced. More recently silicone fluids have again been recognised, as disclosed in JPA-H3-43749.

However, in this application reliance is also placed on mechanical dispersion only and in addition no mention is made of chemical compatibility or most importantly, charge directors, the need for which being well established in the field of liquid electrostatic toners.

It is well known that silicone fluids have low solvent power for plastics and this property is well suited for copy machine components and organic photoconductor life. An unfortunate corollary to this is that many polymers normally used in liquid toners, whether they are chemically prepared such as in U.S. Pat. No. 3,990,980 to G. Kosel or more recently U.S. Pat. No. 5,112,716 to Kato et al or by conventional dispersion techniques such as in JPA-H3-43749, are either insoluble in or incompatible with silicone fluids. This severely limits the particle size attainable and the stability of dispersions thus prepared due to the inability of such polymers to dissolve in the silicone fluid and subsequently to be adsorbed onto dispersed colorants, providing a steric barrier to their reagglomeration.

Thus the need exists for a stable liquid developer which meets modern environmental demands and yet has the imaging capability required by quality printing standards, namely colour gamut and resolution.

Thus an object of the invention is to provide an electrostatographic toner containing an unadulterated silicone fluid as the carrier liquid.

A further object of the present invention is to provide an electrostatographic toner composition containing a synthesised polymer of particle size less than 0.5 micron.

This invention relates to a chemically prepared liquid developer for electrostatography, comprising polymer particles which may contain pigments or dyes as colorants, dispersed in a liquid carrier having an electrical resistance of at least $10^9$-ohm-cm and having a dielectric constant of not more than 3.5. In particular this carrier liquid is further characterised by being silicon containing organic compounds, generally known as silicone fluids.

DISCLOSURE Of THE INVENTION

In one form, therefore the invention is said to reside in a method of forming a liquid developer or a constituent for a liquid developer for electrostatography comprising the steps of dispersing at least one monomer in silicone fluid and polymerising the at least one monomer to form a polymer particles in the silicone fluid.

The resultant liquid developer may be used directly as a developer for electrostatography or may be diluted with more silicone fluid to produce a liquid developer. Hence the product may be a liquid developer or a constituent for a liquid developer.

The silicone fluid may have a viscosity of between 0.65 and 60,000 centistokes.

The silicone fluid may be selected from polyphenylmethylsiloxanes, dimethyl polysiloxanes and polydimethyl cyclosiloxanes.

The liquid developed may further include a polymerisation stabiliser which is compatible with the silicone fluid. The stabiliser may be a silicone fluid with a viscosity of between 30,000 and 60,000 centistokes such as dimethyl polysiloxane and may be added in a range of 5 to 80% with a preferred range being 20 to 35%.

The method may further include the addition of a colorant selected from a dyestuff or a pigment which is added to the silicone fluid before the polymerisation step.

The method may further include the addition of a colorant selected from a dyestuff or a pigment which is added to the silicone fluid after the polymerisation step.

The polymerisation step may be to form a homopolymer from a single monomer. The monomer may be selected from methylmethacrylate to produce polymethylmethacrylate particles, vinyl acetate to produce polyvinyl acetate particles or styrene monomer to give polystyrene particles.

The polymerisation step may be to form a copolymer from two or more different monomers selected from vinyl acetate, styrene, n-vinyl-2-pyrrolidone, acrylic acid and alkyl esters of acrylic acid and methacrylic acid and alkyl esters of methacrylic acid.

The liquid developed may further include a charge director soluble in the silicone fluid.

The invention may also reside in a liquid developer or a constituent of a liquid developer comprising a silicone fluid carrier and polymer particles wherein the polymer of the polymer particles has been polymerised in situ from at least one monomer.

The silicone fluid may have a viscosity of between 0.65 and 60,000 centistokes and be selected from polyphenylmethylsiloxanes, dimethyl polysiloxanes and polydimethyl cyclosiloxanes.

The liquid developed may further include a polymerisation stabiliser which is compatible with the silicone fluid. The stabiliser may be a silicone fluid such as dimethyl polysiloxane and may be added in a range of 5 to 80% with a preferred range being 20 to 35%.

The liquid developer may further include a colorant selected from a dyestuff or a pigment.

The liquid developer may include the polymer formed from a single monomer selected from methylmethacrylate to produce polymethylmethacrylate, vinyl acetate to produce polyvinyl acetate or styrene monomer to give polystyrene.

The liquid developer may include the polymer formed from two or more monomers to form a copolymer in the silicone fluid. The monomers may be two or more of vinyl acetate, styrene, n-vinyl-2-pyrrolidone, acrylic acid and alkyl esters of acrylic acid and methacrylic acid and alkyl esters of methacrylic acid.

The liquid developer may further include a charge director or charge control agent soluble in the silicone fluid.

Hence it will be seen that the present invention provides a liquid electrostatographic toner composition or a constituent of such a composition in which the carrier liquid is purely silicone fluid by chemical nature and is unadulterated by any hydrocarbon based liquid. Particle size, dispersion stability and particle charge may be achieved by a combination of polymer synthesis, mechanical dispersion and compatible charge director.

BEST MODE FOR CARRYING OUT THE INVENTION

The present invention thus provides an improved electrostatographic liquid developer composition containing colorant and polymer dispersed in an electrically insulating silicone fluid.

The invention will now be discussed with reference to a preferred embodiment.

Non-aqueous dispersions of many types of polymers are well known in the art of toner making. However, the non-aqueous phase in these has been limited to hydrocarbon liquids and more specifically to isoparaffinic hydrocarbons. Silicone fluids have not featured in this technology.

Silicone fluids are comprised of a range of compounds, the most commonly encountered types being dimethyl polysiloxanes which have the following chemical structure:

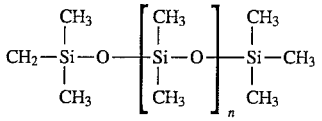

where n may vary from 0 to 2000 and even higher. The higher the value of n the higher the viscosity of the silicone fluid. Viscosity of these particular polysiloxanes can range from 0.65 centistokes to over 1,000,000 centistokes.

For the present invention the viscosity of the silicone fluid may be between 0.65 and 60,000 centistokes.

It has been found by experimentation that the usually employed polymeric stabilisers for non-aqueous polymerisation are not applicable to silicone fluids due to their incompatibility with these compounds. It has also been found that polymerisation of monomers such as vinyl and alkyl esters of aliphatic carboxylic acids is possible in dimethyl polysiloxanes where n is greater than 4 without the need for an additional stabiliser.

It has been found in addition, and unexpectedly, that if such high viscosity dimethyl polysiloxanes are used in their own right as polymerisation stabilisers, then such polymerisation can be carried out in low viscosity silicone fluids such as low viscosity dimethyl polysiloxanes where n is 4 or less. In the absence of these high viscosity dimethyl polysiloxanes, controlled dispersion polymerisation of the aforementioned monomers is not possible.

It has also been found that polymerisation of such monomers can be performed in other silicone fluids of low viscosity such as certain polyphenylmethylsiloxanes and polydimethyl cyclosiloxanes provided a high viscosity dimethyl polysiloxane is present in solution in the primary silicone fluid.

The percentage of high viscosity dimethyl polysiloxane fluid necessary to accomplish controlled dispersion polymerisation in the low viscosity fluids is in the range of 5 to 80% with the preferred range being 20 to 35%. This preferred range allows the preparation of liquid toners of viscosities comparable with those normally experienced by those skilled in the art.

By employing such preferred percentages of high molecular weight, high viscosity dimethyl polysiloxanes in low viscosity silicone fluids, mechanically stable dispersions of such polymers as polyvinyl acetate, polymethylmethacrylate and polystyrene with particle sizes less than 0.5 micron may be prepared.

In the case of colouring the so formed dispersions as a necessary part of the toner making procedure, a method of physically incorporating a pigment or dye into the dispersion can be employed. Alternatively, a pigment or dye can be incorporated into the monomer prior to polymerisation in the silicone fluid. Other methods well known in the art such as the adsorption of dye to the dispersed polymer facilitated by the application of heat to a mixture of dyestuff and the polymer dispersion can also be employed.

It is also well known to those skilled in the art of toner making that liquid toners are more stable and more predictable when materials known as charge directors, charge control agents or charge enhancers are incorporated into the toner composition. Many patents have been granted regarding the composition and efficacy of these materials e.g. in U.S. Pat. No. 3,411,936 to J. Roteman et al, in U.S. Pat. No. 3,417,019 to G. L. Beyer, in U.S. Pat. No. 4,170,563 to S. H. Merrill et al, in 4,897,332 to G. Gibson et al and in U.S. Pat. No. 5,045,425 to R. Swindler. In addition many theoretical papers have been written in attempts to explain the functioning of these additives, e.g. Mechanism of Electric Charging of Particles in Non-aqueous Liquids (Colloids and Surfaces in Reprographic Technology 1982) by F. M. Fowkes et al.

During the course of experimentation with liquid toners based on silicone fluids as the sole liquid carrier we found that the normally employed charge directors are either insoluble or incompatible with silicone fluids. This also occurs with those materials such as certain metallic soaps supplied as solutions, e.g. zirconium octoate, manganese naphthenate and the like, once their solvents have been removed in order not to contaminate the purity of the silicone carrier.

We have found that certain members of a specific class of organo-metallic compounds, the organo-titanates, can, in the complete absence of any other liquid or solvent, be completely dissolved in silicone fluids and in doing so, effect, enhance and stabilise an electrostatic charge on polymer and colorant particles dispersed in that silicone fluid by the procedures taught herein.

Specific examples of such organo-titanates are tetra-2-ethyl hexyl titanate, tetra n-butyl titanate and tetra isopropyl titanate. The organo-titanate can be used in the liquid toner of the present invention in quantities of 0.01 to 10% by weight of the dispersed polymer, with a preferred range of 0.1 to 2% by weight.

Hence liquid developer compositions as set forth in the following examples exemplify and are within the scope of the present invention.

EXAMPLE 1

In Situ Polymerisation of Vinyl Acetate in Low Viscosity Polymethyl Siloxane

| | |
|---|---|
| a) DC 345 Fluid | 375 g |
| DC 200 Fluid | 25 g |
| vinyl acetate | 100 g |
| aibn | 0.5 g |

DC 345 Fluid is a silicone fluid with a viscosity of 20 centistokes

DC 200 Fluid is a silicone fluid with a viscosity of 60,000 centistokes aibn is azo iso butyro nitrile, a polymerisation initiator.

The above ingredients were heated under reflux conditions with stirring for 30 minutes at 90° C. In this example the DC 200 fluid is acting as the polymerisation stabiliser. A white latex solution of poly vinyl acetate was so formed which had a solid content of 28% and a viscosity of 65 mPa.s.

| | |
|---|---|
| b) DC 345 Fluid | 375 g |
| DC 200 Fluid 60,000 cs | 25 g |
| 5% crystal violet in methanol | 10 g |
| vinyl acetate | 100 g |
| aibn | 0.5 g |

The above ingredients were heated under reflux conditions with stirring for 30 minutes at 90° C. A violet coloured latex solution of poly vinyl acetate was so formed which had a solid content of 28% and a viscosity of 65 mPa.s.

EXAMPLE 2

In Situ Polymerization of Vinyl Acetate in High Viscosity Polymethyl Siloxane

| | |
|---|---|
| DC 200 Fluid | 600 g |
| vinyl acetate | 150 g |
| aibn | 1 g |

The above ingredients were heated under reflux conditions with stirring for 3 hours at 100° C. A thick, white latex solution of poly vinyl acetate was so formed which had a solid content of 16% and a viscosity of 62,000 mPa.s.

EXAMPLE 3

Silicone Toner Formulation Using Pigment

| | |
|---|---|
| Resin latex formed in Example 1 | 100 g |
| Phthalocyanine blue pigment, | 25 g |
| DC 344 Fluid | 300 g |

DC344 Fluid is a silicone fluid with a viscosity of 2 centistokes

The above ingredients were added to a ball jar and milled for 2 days to prepare a blue resinous toner. This was diluted 50-fold in DC344 Fluid and then tested in an electrostatic colour proofer.

Images were of poor quality with poor edge acuity.

EXAMPLE 4

Silicone Toner Formulation Using Pigment and Zirconium Octoate Charge Control Agent

| | |
|---|---|
| Resin latex formed in Example 1 | 100 g |
| Phthalocyanine blue pigment, | 25 g |
| 6% Zirconium Octoate | 5 g |
| DC 344 Fluid | 300 g |

The above ingredients were added to a ball jar and milled for 2 days to prepare a blue resinous toner. This was diluted 50-fold in DC344 and then tested in an electrostatic colour proofer.

Images were of moderate quality with improved edge acuity. Maximum image density was 0.6 optical density units (odu) as measured using a Gretag SP100 reflection densitometer.

EXAMPLE 5

Silicone Toner Formulation Using Pigment and Tetra Octyl Titanate Charge Control Agent

| | |
|---|---|
| Resin latex formed in Example 1 | 100 g |
| Phthalocyanine blue | 25 g |
| Tetra Octyl Titanate | 1 g |
| DC 344 Fluid | 300 g |

The above ingredients were added to a ball jar and milled for 2 days to prepare a blue resinous toner. This was diluted 50-fold in DC344 Fluid and then tested in an electrostatic colour proofer.

Images were of good quality and showed good edge acuity. Maximum image density was 0.8 odu.

EXAMPLE 6

Silicone Toner Formulation Using Pigment and Tetra Octyl Titanate Charge Control Agent

| | |
|---|---|
| Resin latex formed in Example 2 | 50 g |
| Rubine 4B Toner | 50 g |
| 6% Zirconium Octoate | 3 g |
| DC 344 Fluid | 400 g |

The above ingredients were added to a ball jar and milled for 24 hours to prepare a red dispersion.

This toner was used to develop a charged dielectric film and gave very good image quality with low background stain. Maximum image density was 0.6 odu.

EXAMPLE 7

In Situ Polymerization of Styrene/Methyl Methacrylate Copolymer in Low Viscosity Polymethyl Siloxane

| | |
|---|---|
| a) DC 345 Fluid | 350 g |
| DC 200 Fluid | 50 g |

The above ingredients were heated to 100° C. in a 2 liter reaction vessel fitted for reflux. The following was then added, dropwise and with stirring.

| | |
|---|---|
| methyl methacrylate | 70 g |
| styrene | 30 g |
| aibn | 1 g |

After one hour, a white latex solution of styrene/methyl methacrylate copolymer which had a solid content of 15% had formed.

We claim:

1. A method of forming a liquid developer or a constituent of a liquid developer for electrostatography comprising the steps of dispersing at least one monomer in silicone fluid and polymerizing the at least one monomer to form polymer particles in the silicone fluid further including a polymerization stabilizer which is compatible with the silicone fluid wherein the polymerization stabilizer is a silicone fluid having a high viscosity.

2. A method as in claim 1 wherein the silicone fluid is selected from polyphenylmethylsiloxanes, dimethyl polysiloxanes and polydimethyl cyclosiloxanes.

3. A method as in claim 1 wherein the silicone fluid has a viscosity of between 0.65 and 60,000 centistokes.

4. A method as in claim 1 wherein the polymerisation stabiliser has a viscosity of between 30,000 and 60,000 centistokes.

5. A method as in claim 4 wherein the polymerisation stabiliser is dimethyl polysiloxane.

6. A method as in claim 5 wherein the dimethyl polysiloxane is added in a range of 5 to 80%.

7. A method as in claim 5 wherein the dimethyl polysiloxane is added in a range of 20 to 35%.

8. A method as in claim 1 further including the step of adding a colorant selected from a dyestuff or a pigment to the silicone fluid before the polymerisation step.

9. A method as in claim 1 further including the step of adding a colorant selected from a dyestuff or a pigment to the silicone fluid after the polymerisation step.

10. A method as in claim 9 wherein the monomer is selected from methylmethacrylate to produce polymethylmethacrylate particles, vinyl acetate to produce polyvinyl acetate particles or styrene monomer to give polystyrene particles.

11. A method as in claim 1 wherein the monomer is formed from two different monomers to give a copolymer.

12. A method as in claim 11 wherein the monomer is selected from two or more of vinyl acetate, styrene, n-vinyl-2-pyrrolidone, acrylic acid and alkyl esters of acrylic acid and methacrylic acid and alkyl esters of methacrylic acid.

13. A method as in claim 1 further including a charge director soluble in the silicone fluid.

14. A liquid developer or a constituent of a liquid developer comprising a silicone fluid carrier and polymer particles wherein the polymer of the polymer particles has been polymerized in situ from at least one monomer and a polymerization stabilizer which is compatible with the silicone fluid wherein the polymerization stabilizer is a silicone fluid having a high viscosity.

15. A liquid developer or a constituent of a liquid developer as in claim 14 wherein the silicone fluid is selected from polyphenylmethylsiloxanes, dimethyl polysiloxanes and polydimethyl cyclosiloxanes.

16. A liquid developer or a constituent of a liquid developer as in claim 14 wherein the silicone fluid has a viscosity of between 0.65 and 60,000 centistokes.

17. A liquid developer or a constituent of a liquid developer as in claim 14 wherein the polymerisation stabiliser has a viscosity of between 30,000 and 60,000 centistokes.

18. A liquid developer or a constituent of a liquid developer as in claim 17 wherein the polymerisation stabiliser is dimethyl polysiloxane.

19. A liquid developer or a constituent of a liquid developer as in claim 18 wherein the dimethyl polysiloxane is present in a range of from 5 to 80%.

20. A liquid developer or a constituent of a liquid developer as in claim 18 wherein the dimethyl polysiloxane is added in a range of 20 to 35%.

21. A liquid developer or a constituent of a liquid developer as in claim 14 further including a colourant selected from a dyestuff or a pigment.

22. A liquid developer or a constituent of a liquid developer as in claim 15 wherein the polymer is formed from a single monomer selected from methylmethacrylate to produce polymethylmethacrylate, vinyl acetate to produce polyvinyl acetate or styrene monomer to give polystyrene.

23. A liquid developer or a constituent of a liquid developer as in claim 14 wherein the polymer is formed from more than one monomer to form a copolymer in the silicone fluid.

24. A liquid developer or a constituent of a liquid developer as in claim 14 wherein the polymer is formed from two or more monomers selected from vinyl acetate, styrene, n-vinyl-2-pyrrolidone, acrylic acid and alkyl esters of acrylic acid and methacrylic acid and alkyl esters of methacrylic acid.

25. A liquid developer or a constituent of a liquid developer as in claim 14 further including a charge director or charge control agent soluble in the silicone fluid.

26. A liquid developer or a constituent of a liquid developer formed by the method of claim 1.

* * * * *